US007026824B2

(12) United States Patent
Chen

(10) Patent No.: US 7,026,824 B2
(45) Date of Patent: Apr. 11, 2006

(54) VOLTAGE REFERENCE GENERATOR WITH NEGATIVE FEEDBACK

(75) Inventor: Yung-Hung Chen, Junghe (TW)

(73) Assignee: Faraday Technology Corp., Hsin-Chu (TW)

( * ) Notice: Subject to any disclaimer, the term of this patent is extended or adjusted under 35 U.S.C. 154(b) by 0 days.

(21) Appl. No.: 10/699,390

(22) Filed: Oct. 31, 2003

(65) Prior Publication Data

US 2005/0093616 A1 May 5, 2005

(51) Int. Cl.
*G05F 1/10* (2006.01)
*G05F 3/02* (2006.01)

(52) U.S. Cl. ..... 324/541; 323/280

(58) Field of Classification Search ..... 327/538, 327/540–541, 543; 323/316, 280
See application file for complete search history.

(56) References Cited

U.S. PATENT DOCUMENTS

| | | | | |
|---|---|---|---|---|
| 5,221,890 | A * | 6/1993 | Shyu et al. | 323/317 |
| 6,064,258 | A * | 5/2000 | Shulman | 330/9 |
| 6,111,457 | A * | 8/2000 | Lim et al. | 327/541 |
| 6,362,691 | B1 * | 3/2002 | Forbes | 330/303 |
| 6,433,521 | B1 * | 8/2002 | Chen et al. | 323/224 |
| 6,614,295 | B1 * | 9/2003 | Tsuchi | 327/563 |
| 6,778,007 | B1 * | 8/2004 | Lim | 327/541 |
| 2003/0011350 | A1 * | 1/2003 | Gregorius | 323/282 |
| 2004/0150464 | A1 * | 8/2004 | Khalid | 327/541 |

* cited by examiner

*Primary Examiner*—Quan Tra
(74) *Attorney, Agent, or Firm*—Winston Hsu

(57) ABSTRACT

A voltage reference generator for generating an output voltage at an output node. A level shifter shifts a first reference voltage into the output voltage at the output node according to a shift between the first reference voltage and the output voltage, and a feedback circuit monitors the output voltage and a second reference voltage to control the shift and normalize the output and second reference voltages.

12 Claims, 4 Drawing Sheets

VOLTAGE REFERENCE GENERATOR WITH NEGATIVE FEEDBACK

BACKGROUND OF THE INVENTION

1. Field of the Invention

The present invention relates to analog-to-digital converters (ADCs), and more particularly, to a voltage reference generator with negative feedback for use in establishing reference voltages for ADCs.

2. Description of the Related Art

Switched capacitor ADCs provide efficient high speed analog-to-digital signal conversion. A representative switched capacitor ADC 10 is shown in FIG. 1, in the form of a multi-stage pipelined ADC. As shown, ADC 10 includes multiple stages, such as stages 11 and 12, each providing one or more bits of digital data to a digital correction circuit 15, which resolves the digital output from each stage into an overall digital output 16 corresponding to an analog input 17. Each stage is a switched capacitor circuit operating in response to clock signals such as phi 1 and phi 2 and comparing an analog voltage input to thresholds based on reference signals Vrefp and Vrefn, to produce digital output.

For proper operation of ADC 10, generators are needed for phase and timing signals as well as for reference voltages, as shown respectively at 20 and 30 of FIG. 1. Thus, generator 20 for phase and timing signals generates clock signal phi 1 for use during the sample phase of multiple stages 11 and 12, as well as clock signal phi 2 for use during the amplification phase of multiple stages 11 and 12. Likewise, generator 30 generates reference voltages Vrefp and Vrefn for use by multiple stages 11 and 12. The design of the present application applies to the generator 30 for the reference voltages.

FIG. 2 shows a conventional generator 30 for generating reference voltage Vrefp, with a similar circuit, shown schematically at 31, to generate reference voltage Vrefn. As shown in FIG. 2, generator 30 includes a source follower 32 connected between voltage source V+ and a current source 35 which, in turn, is connected to ground. Source follower 32 is driven at its gate side by amplifier 34, connected via negative feedback using a reference voltage Vref as a reference and the output Vrefp as negative feedback.

With this arrangement, source follower 32 is driven by amplifier 34 to provide output Vrefp with good current capabilities stabilized through negative feedback at a voltage level corresponding to Vref.

However, in use of generator 30 shown in FIG. 2, for example, due to higher frequency switching of generator 30, and due to noise/glitches generated by ADCs, the amplifier 34 (FIG. 2) must respond promptly, reacting quickly to recovery Vrefp to an ideal value to avoid noise (e.g., preferably within a fraction of a clock period). However, this is difficult to achieve for high speed ADCs. An alternative is to use an external capacitor $C_{EXT}$ (e.g., with a sufficiently large capacitance) to lower the impedance seen by the reference at high frequencies. This alternative may minimize switching glitches and noise, but it also requires extra circuitry, and for example, an extra pin.

Another conventional reference voltage generator is shown in FIG. 3. As shown, the generator uses an operational amplifier (OP-AMP) 40, connected via negative feedback through its output of the OP-AMP.

Although the generator in FIG. 3 requires no external capacitor, and can be designed for use with high bandwidth applications, the OP-AMP requires a large power supply, and the circuit area is large.

SUMMARY OF THE INVENTION

Accordingly, an object of the present invention is to provide an improved voltage reference generator capable of securing stable, speedy operation with decreased power supply voltage and circuit area.

In order to achieve the above object, the invention provides a voltage reference generator for generating an output voltage at an output node, which comprises a level shifter for shifting a first reference voltage into the output voltage at the output node according to a shift between the first reference voltage and the output voltage, and a feedback circuit for monitoring the output voltage and a second reference voltage to control the shift and to normalize the output and second reference voltages.

A detailed description is given in the following with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
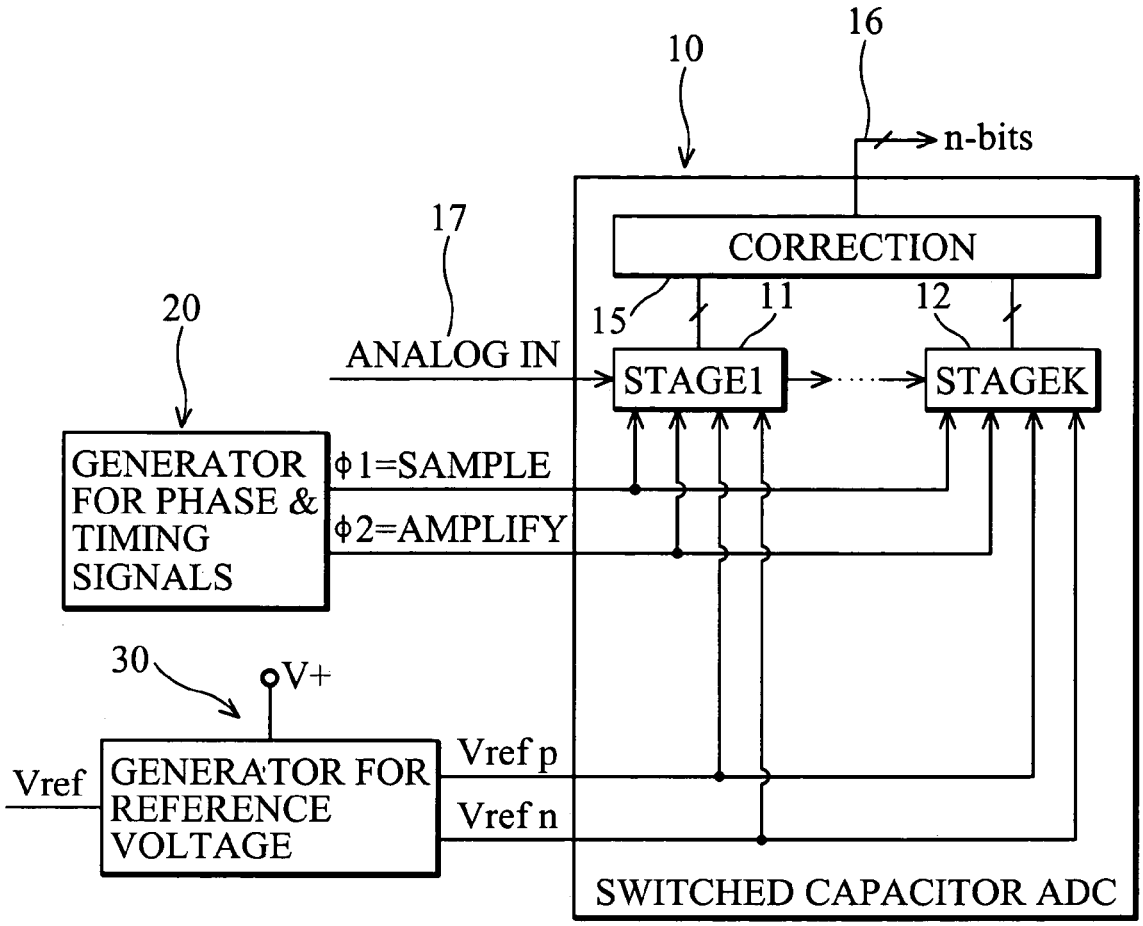
FIG. 1 (RELATED ART)
FIG. 1 is a schematic circuit diagram showing a representative switched capacitor ADC.
Figure 2:
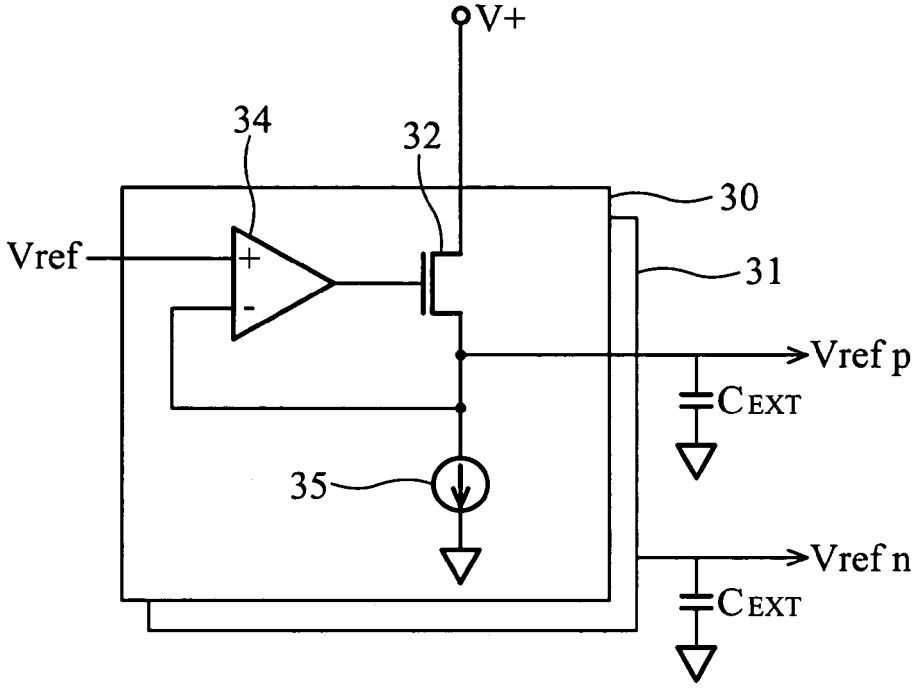
FIG. 2 (RELATED ART)
FIG. 2 is a conventional schematic diagram showing a reference voltage generator.
Figure 3:
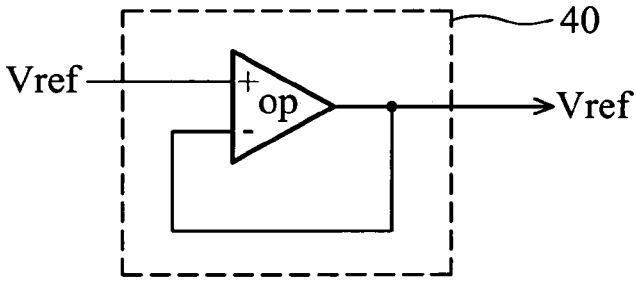
FIG. 3 (RELATED ART)
FIG. 3 is a schematic diagram showing another conventional reference voltage generator.
Figure 4:
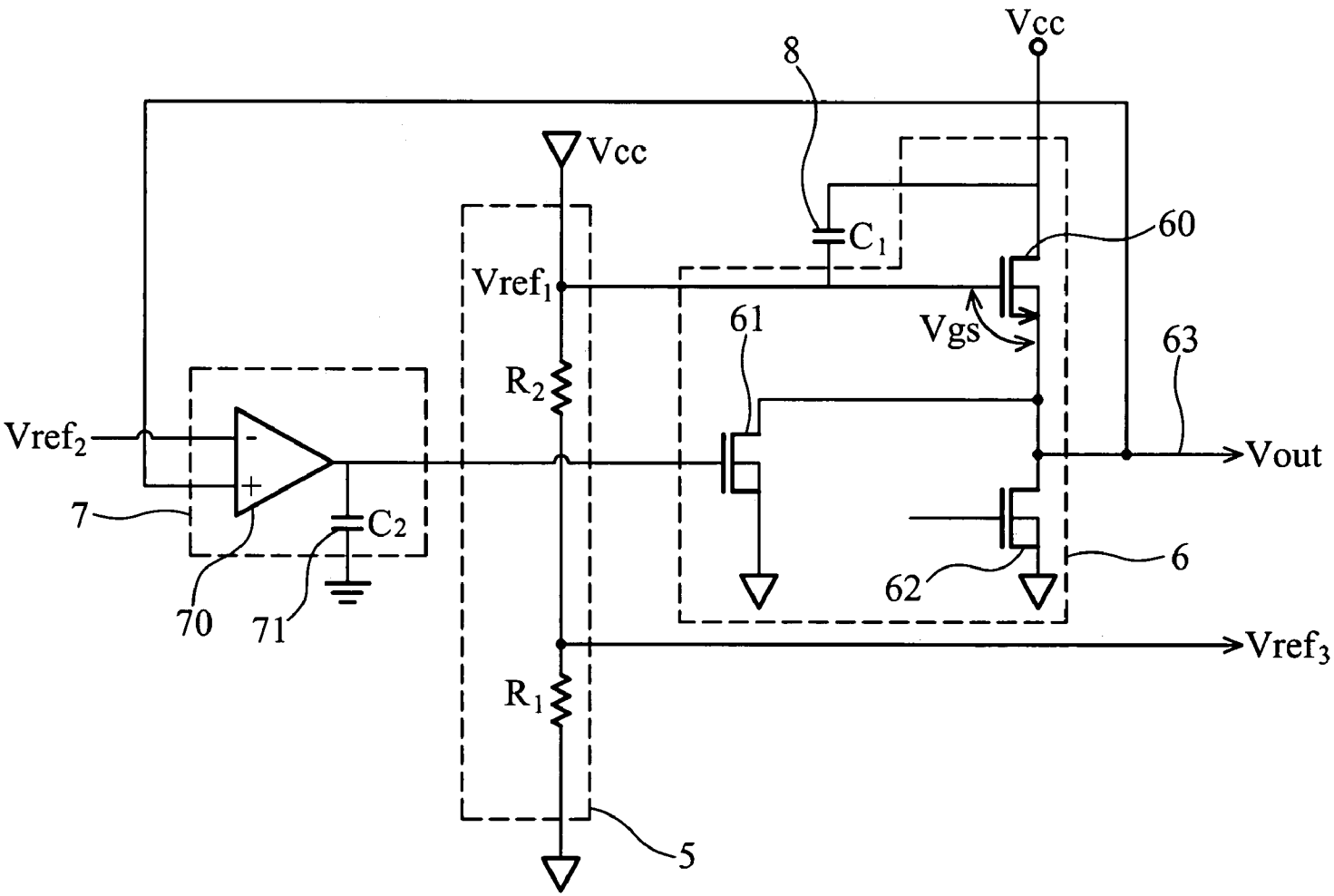
FIG. 4 is a circuit diagram of a reference voltage generator according to one embodiment of the present invention.

FIG. 4 is a circuit diagram of a reference voltage generator according to one embodiment of the present invention.

The reference voltage generator includes a voltage divider 5, a level shifter 6, a feedback circuit 7, and a filter 8.

The voltage divider 5 includes two resistors R1 and R2, coupled to the voltage source VCC, generating a reference voltage Vref1 and another reference voltage Vref3.

The level shifter 6 includes NMOS transistor 60 as a source follower, NMOS transistor 61 as a current source, and NMOS transistor 62 as a constant current source. NMOS transistor 60 has a drain terminal connected to a voltage source (VCC), a source as an output node 63, and a gate as an input node for receiving the first reference Vref1. As is known, an MOS transistor acts as a source follower if its gate acts as input and its source acts as output. Furthermore, the voltage at the output of a source follower will "follow" the voltage at the input of the source follower, and, nevertheless, differ by a fixed voltage difference or "shift". This shift is determined by the bias current through the source follower. In other words, a source follower also acts as a level shifter with a shift. In FIG. 4, two current sources determine the bias current through NMOS transistor 60, one a controllable current source, NMOS transistor 61, and the other a constant current source, NMOS transistor 62. NMOS transistor 61 has a drain connected to the output node 63, a source connected to ground (GND), and a gate terminal connected to the output of the feedback circuit 7. NMOS transistor 62 is connected between the output node 63 and GND (a lower voltage source).

The feedback circuit 7 has a differential amplifier 70 and a low-pass filter 71. The differential amplifier has an inverted input, a non-inverted input and an output, the non-inverted input coupled to the output node 63 of the level shifter 6, the inverted input coupled to a second reference voltage $V_{ref2}$, and the output coupled to NMOS transistor 61 in the level shifter 6 to control the shift of the level. The low-pass filter 71 is a capacitor $C_2$ connected between an input node of the level shifter 6 and a low voltage source (GND).

The filter 8 is a capacitor $C_1$ connected between the gate of NMOS transistor 60 and the voltage source $V_{CC}$, to filter out a high frequency portion of the first reference voltage and to feed the first reference voltage to the level shifter.

In practice, when output voltage $V_{out}$ at the output node 63 is pulled high ($V_{out}>V_{ref2}$), the differential voltage at output node of the differential amplifier 70 is increased, this increment makes the voltage at the gate of the NMOS transistor 61 increase, too, and control the current through the NMOS transistor 61 increase. Besides, voltage at the gate-source junction ($V_{gs}$) of the first NMOS transistor 60 is decreased because voltage $V_{out}$ at the output node 63 is pulled high, and control the current flowed by the NMOS transistor 60 decreasing. Because the current at the NMOS transistor 61 increase and the current at the NMOS transistor 60 decrease, so the voltage $V_{out}$ at the output node 63 will be pulled low until $V_{out}=V_{ref2}$. On the contrary, when output voltage $V_{out}$ at the output node 63 is pulled low ($V_{out}<V_{ref2}$), the voltage at the non-inverting input will be pulled low, too. The differential voltage value at output node of the differential amplifier 70 is pulled down, and makes the current at the NMOS transistor 61 decreased. Besides, voltage at the gate-source junction ($V_{gs}$) of the NMOS transistor 60 increases because voltage $V_{out}$ at the output node 63 is pulled low, so the current flowed by the first NMOS transistor 60 is increased, and the voltage $V_{out}$ at the output node 63 will be pulled high until $V_{out}=V_{ref2}$.

The invention provides an improved voltage reference generator capable of securing stable, speedy operation by transistors 60 and 61 controlling the shift of the voltage Vout. As well, the invention requires no external capacitor, providing decreased power supply voltage and circuit area.

Figure 5:
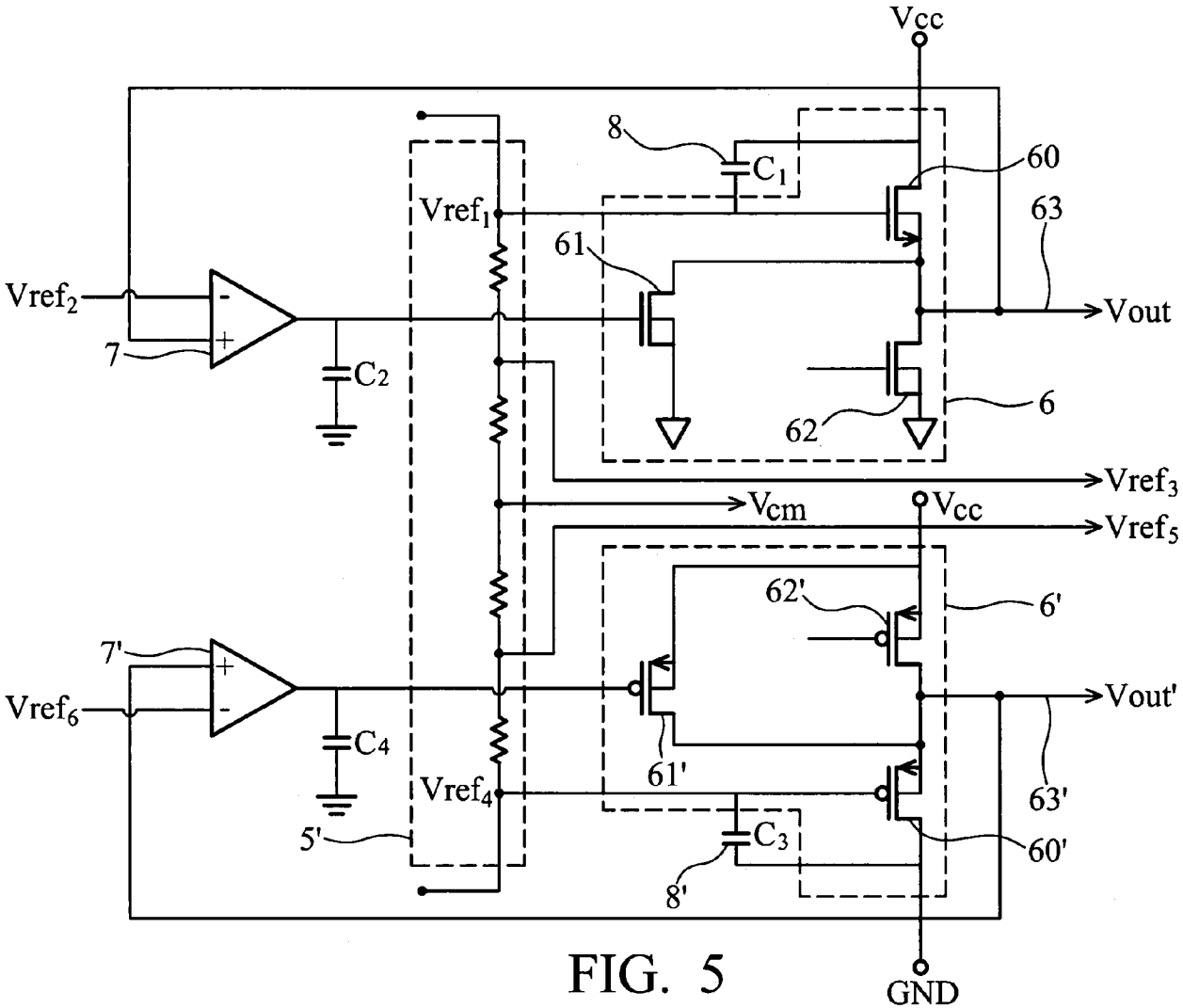
FIG. 5 is a circuit diagram of a reference voltage generator according to another embodiment of the present invention.

The invention can be designed as a fully differential reference voltage generator (shown in FIG. 5), designed by two reference voltage generators, including two level shifter 6, 6', two feedback circuits 7,7', and two filters 8, 8'. Since the NMOS transistors 60, 61, and 62 and their configuration are the same as the embodiment in FIG. 4, no further description is made. The main difference in this embodiment is that the components of the level shifter 6' are all PMOS transistors. The level shifter 6' has a PMOS transistor 60' as a source follower, a PMOS transistor 61' as a current source, and a PMOS transistor 62' as a constant current source. The PMOS transistor 60' has a drain terminal connected to a voltage source VGND, a source as an output node 63', and a gate as an input node for receiving a forth reference Vref4. The PMOS transistor 61' has a drain connected to the output node 63', a source connected to voltage source $V_{CC}$, and a gate terminal connected to the output of the feedback circuit 7'. The PMOS transistor 62' is connected between the output node 63' and voltage source $V_{CC}$.

While the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation to encompass all such modifications and similar arrangements.

What is claimed is:

1. A voltage reference generator for generating an output voltage at an output node, comprising:

a level shifter for shifting a first reference voltage into the output voltage at the output node according to a shift between the first reference voltage and the output voltage;

a feedback circuit for monitoring the output voltage and a second reference voltage to control the shift and to normalize the output and second reference voltages;

a voltage divider to provide the first reference voltage according to an power source, wherein the first reference voltage is independent to the output voltage; and a low-pass filter to filter out a high frequency portion of the first reference voltage and direct the first reference voltage to the level shifter.

2. The voltage reference generator as claimed in claim 1, wherein the level shifter includes a source follower coupled between the voltage source and the output node, the source follower having an input node for receiving the first reference voltage.

3. The voltage reference generator as claimed in claim 2, wherein the source follower has an MOS transistor having a drain connected to the voltage source, a source as the output node and a gate as the input node, and further having a current source controlled by the feedback circuit and connected to the source of the MOS transistor.

4. The voltage reference generator as claimed in claim 3, wherein the MOS transistor is a NMOS transistor.

5. The voltage reference generator as claimed in claim 3, wherein the MOS transistor is a PMOS transistor.

6. The voltage reference generator as claimed in claim 3, wherein the current source is an MOS transistor having a drain connected to the output node, a source connected to a ground, and a gate connected to the output of a differential amplifier.

7. The voltage reference generator as claimed in claim 3, wherein the level shifter further comprises a constant current source coupled between the output node and another voltage source.

8. The voltage reference generator as claimed in claim 6, wherein the MOS transistor is a NMOS transistor.

9. The voltage reference generator as claimed in claim 1, wherein the low-pass filter comprises at least a capacitor connecting an input node of the level shifter and a voltage source.

10. The voltage reference generator as claimed in claim 1, wherein the feedback circuit has a differential amplifier with an inverted input, a non-inverted input and an output, the non-inverted input coupled to the output node, the inverted input coupled to the second reference voltage, and the output coupled to a current source in the level shifter to control the shift of the level.

11. The voltage reference generator as claimed in claim 10, wherein the feedback circuit further has a low-pass filter connected between output of the differential amplifier and current source in the level shifter.

12. The voltage reference generator as claimed in claim 1, wherein the first reference voltage is not generated or controlled by the output voltage.

* * * * *